US005133671A

United States Patent [19]

Boghosian

[11] Patent Number: 5,133,671

[45] Date of Patent: Jul. 28, 1992

[54] COMBINED LOCK FOR ELECTRICAL CONNECTORS AND CABLE KEEPER

[76] Inventor: Michael A. D. Boghosian, 2500 52nd St., Sacramento, Calif. 95819

[21] Appl. No.: 701,692

[22] Filed: May 13, 1991

[51] Int. Cl.[5] ..... H01R 13/62

[52] U.S. Cl. ..... 439/371; 439/369; 439/501; 24/16 PB

[58] Field of Search ..... 439/369, 368, 370, 367, 439/371, 501; 24/16 PB, 16 R

[56] References Cited

U.S. PATENT DOCUMENTS

| | | | |
|---|---|---|---|
| 2,725,543 | 11/1955 | Tanner | 439/371 X |
| 2,961,785 | 11/1960 | Toepfer | 40/21 |
| 3,197,830 | 8/1965 | Hoadley | 24/16 |
| 3,255,501 | 6/1966 | Laguerre | 24/16 |
| 3,475,716 | 10/1969 | Laig | 24/16 PB |
| 4,145,105 | 3/1979 | Dobson | 439/369 |
| 4,247,743 | 1/1981 | Hinton et al. | 439/371 X |
| 4,477,950 | 10/1984 | Cisek et al. | 24/30.5 |
| 4,957,450 | 9/1990 | Pioszak | 439/371 X |

FOREIGN PATENT DOCUMENTS 903599 3/1960 United Kingdom .

*Primary Examiner*—Larry I. Schwartz
*Assistant Examiner*—Khiem Nguyen
*Attorney, Agent, or Firm*—David Pressman

[57] ABSTRACT

A combined releasable holder and lock for electrical connections and cables comprises a pair of identical, strip-like flexible members. Each has a first narrow end or tongue (16), a second wide end or head portion (18), and an intermediate portion with serrations (12 and 14) on its opposite sides. The longitudinal axis of the member has a longitudinal slot (30) which is long enough to pull a cord (39 or 41) with a standard electrical plug (32) or receptacle (34) therethrough. The head portion (18) has a transverse slot (20) formed therein. The member has, on both sides of the transverse slot, two side slots (22 and 24) which converge in a direction opposite to the tongue (16). The end of the long slot (30) nearest the transverse slot (20) terminates in a hole (28). The slots (20, 22, and 24) in the head portion form bendable flaps (23 and 25). The plug and the receptacle are pulled through the longitudinal slots of two members, and then the tongue of one is pulled through the transverse slot of the second, while the tongue of the second is pooled through the transverse slot of the first member. When both tongues are pulled, the serrations bend the flaps out and pass through the material of the strip in one direction but cannot easily pass in the opposite direction. The plug and receptacle are firmly clamped between both straps.

17 Claims, 3 Drawing Sheets

COMBINED LOCK FOR ELECTRICAL CONNECTORS AND CABLE KEEPER

BACKGROUND

1. Field of the Invention

The present invention relates to holding and locking devices, particularly to a combined lock for electrical connections and a keeper for electrical cables or cords.

2. Description of Prior Art

Nowadays there is no household, office, or a production facility which does not use electrical appliances, instruments, computers, or similar devices which are connected to a source of electricity by a cable or cord. In many cases, in order to provide the possibility for future rearranging of the positions of such devices, electric cables are provided with excess length. For shortening the effective length of the cable and protecting it from entanglement or spreading over a large area of the floor, which presents a hazard, the cable must be folded or coiled into a number of loops.

It is also more convenient to keep long cords and cables in a coiled or looped form in storage or during transportation.

In order to keep such a bundle in a releasable state, special cable or cord keepers or holders are provided. One such holder, which is described in U.S. Pat. No. 3,197,830 to Robert Hoadly, 1965, comprises a plastic strip with a narrow portion having serrations on one side thereof and a widened portion with a transverse slot for inserting the narrow portion and tightening the strip around the bundle.

When it is desired to use the cord, the narrow end of the strip-like holder is withdrawn from the transverse slot or aperture and the looped portions of the cord can be unfolded.

Although such a device is suitable for keeping cables or cords in a looped form, it can do only this and is unsuitable for any other function.

Many devices are known and available on the market for holding plug connections tight. One such device, which is produced by Colton Creators, Inc., Mineola, N.Y., consists of two L-shaped members interconnected into a U-shaped yoke through a releasable ratchet connection. This connection is formed by a tooth rack on the surface of one of the members and a spring tooth on another element which normally is kept in locking engagement with the rack. A plug and a receptacle, which are electrically interconnected with each other, are held together between two parallel sides of the U-shaped yoke formed by both elements.

Such a device is three-dimensional, has a complicated construction, is expensive to manufacture, and occupies a large space. It also has only one function and is not capable of any additional functions.

OBJECTS AND ADVANTAGES OF THE INVENTION

It is therefore an object of the invention to eliminate the above disadvantages. Other objects and advantages are to provide a combined lock for electrical connections and a keeper for electrical cables which can be used either for keeping an electrical cord in a folded or looped condition, or for holding mated electrical plug and receptacle together. Further objects are to provide a device of the above-mentioned type which is composed of two identical elements, simple and inexpensive to manufacture, easy to use, reliable in operation, and convenient to store and transport. Still further features and advantages of the invention will become apparent after the consideration of the ensuing description with reference to the accompanying drawings.

REFERENCE NUMERALS USED IN THE DRAWINGS AND DESCRIPTION

Figure 1:
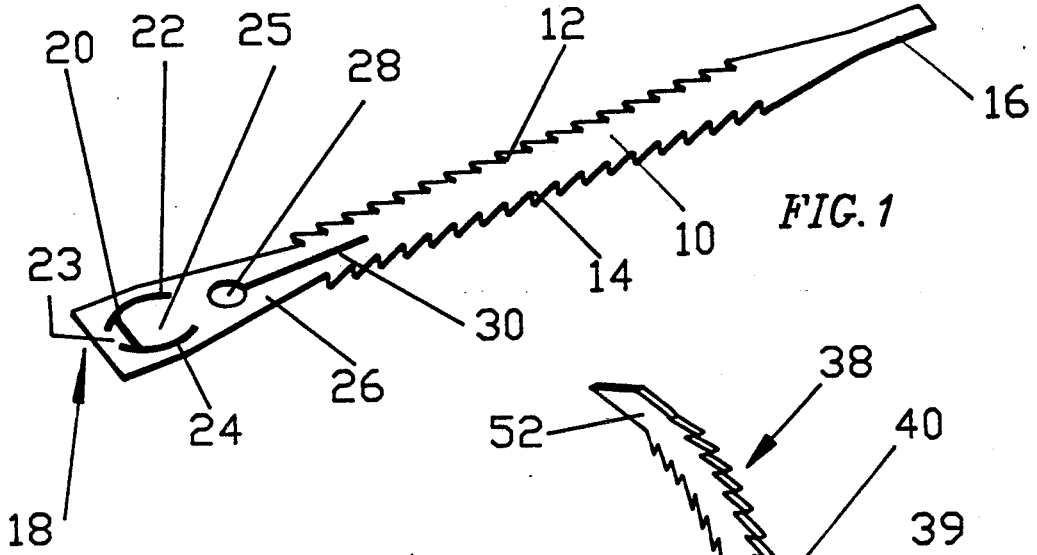
FIG. 1 is a perspective view of a locking strip according to the invention.

10 - wide portion
12, 14 -serrations
16 - narrow tongue
18 - head
20 - transverse slot
22, 24 - side slots
23 - small flap
25 - large flap
26 - tapering portion
28 - through hole
30 - longitudinal slot
32 - plug
34 - receptacle
36, 38 - locking strips
39, 41 - cords
40, 42 - longitudinal slots
44 - prongs
46 - recesses
48, 52 - tongues
50, 54 - transverse slots
55 - head portion
60 - tongue
62 - transverse slot
64, 66, 68 - adjacent locking strips formed by die
a - overall length
b - overall width
c - distance between cavities of serrations
d - distance between the tips of serrations
f - minimum distance between side slots
g - length of transverse slot
h - maximum distance between side slots
X - longitudinal axis
A, B - pulling direction of tongues
C - pulling direction of head for releasing

Figure 1A:
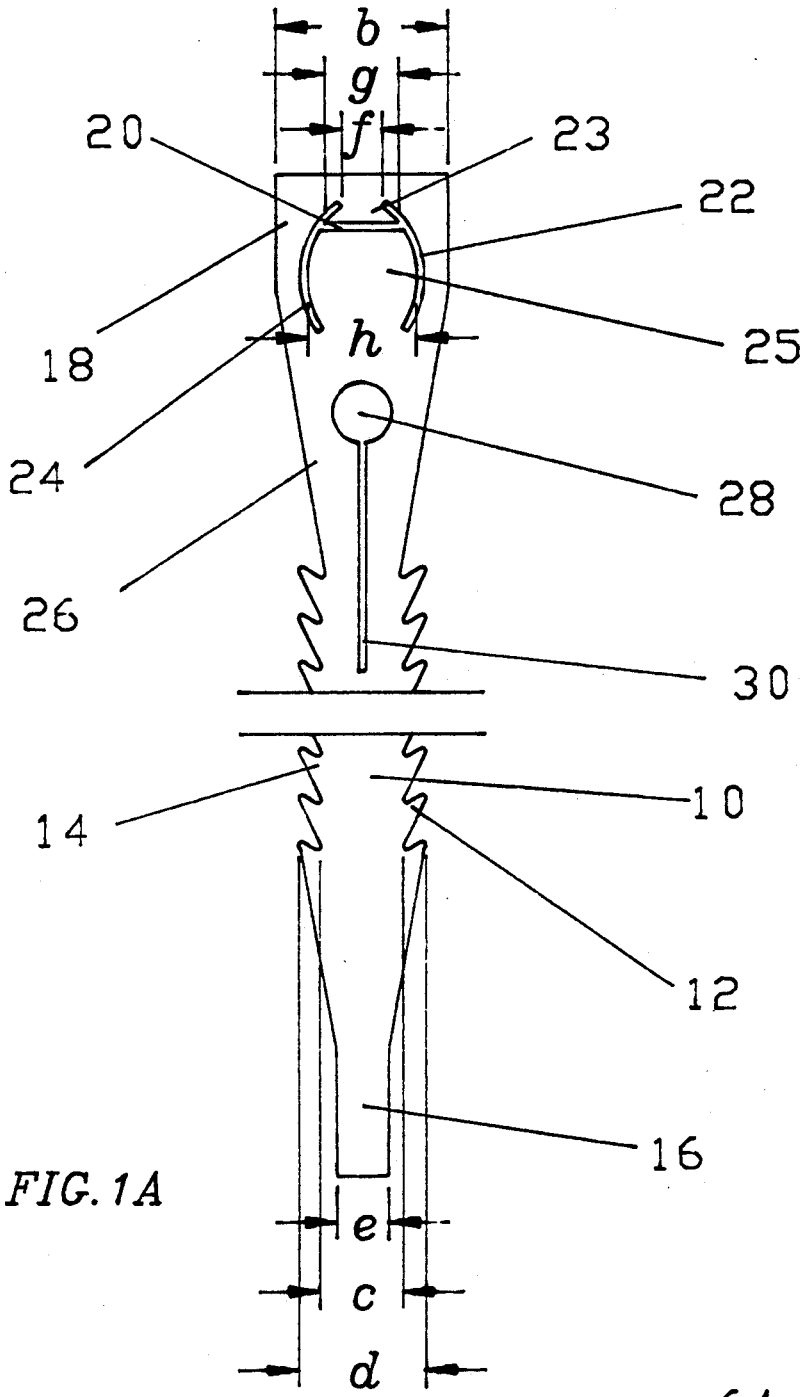
FIG. 1*a* is top view of the locking strip of FIG. 1.

FIGS. 1, 1*a*—DETAILED DESCRIPTION OF THE LOCKING AND HOLDING DEVICE OF THE INVENTION

A combined cord keeper and plug and receptacle holder of the invention is composed of two identical strip-like elements, one of which is shown in FIG. 1. A top view of the locking strip of FIG. 1 is shown in FIG. 1a.

Each element is made by stamping from a sheet plastic material in the form of a strip which has a wide portion 10 with sawtooth serrations 12 and 14 on the opposite sides. One end of the strip is pointed and formed as a flexible narrow tongue 16, while at the opposite end of the strip is a head 18 which is widened to accommodate a transverse slot 20 and two side slots 22 and 24 which converge slightly in the direction opposite to tongue 16. Transverse slot 20 is cut through the entire width between side slots 22 and 24 so that it interconnects both side slots. However, in the axial direction it is slightly spaced from the narrowest distance between the side slots. In combination with each other, transverse slot 20 and side slots 22 and 24 form two flap-like pieces separated by transverse slot 20, i.e., a smaller flap 23 and a larger flap 25. When tongue portion 16 is inserted into transverse slot 20 of its own strip or another identical strip and is pulled further through transverse slot 20 and side slots 22 and 24, smaller flap 23 gives way. This allows the bite of the serrated edges to wedge and larger flap 25 force the serrated edges into slot 20 and retains them in position, securing the device.

Serrations or teeth 12 and 14 are symmetrical and are inclined in a herringbone pattern so that the tips of the serrations face head 18 of the strip.

The serrated portion of the strip is connected to head 18 by a tapering portion 26. A through hole 28 is formed in tapering portion 26. Hole 28 is located on the longitudinal axis X of the strip in a position close to the wide end of tapering portion 26.

An essential feature of the strip element of the invention is a longitudinal slot 30 which extends along longitudinal axis X from hole 28 to the intermediate part of the serrated portion of the strip. The length of slot 30 should be sufficient so that a plug or socket (FIG. 2) of an electrical appliance or instrument can be pulled therethrough. Hole 28 assists in opening slot 30 and also serves to retain the cord after pulling the plug or receptacle through slot 30.

The locking strip can be made of a flexible and durable sheet of plastic, such as polyethylene or nylon.

Dimensional characteristics of the above-described locking strip are as follows (FIG. 1A): its overall length (dimension "a") may vary between 100 mm and 300 mm; overall width (dimension "b") may vary between 12 mm and 38 mm; the thickness of the plastic sheet material from which the strip is made, e.g., by stamping, may vary between 0.8 mm and 9.5 mm; longitudinal slot 30 may have a length varying between 12 mm and 90 mm to allow insertion therethrough of a standard cord plug or receptacle; the distance "d" between the tips of serrations 12 and 14 is approximately ⅔rd of width "b", depending on the properties of the material used; the distance between the troughs of serrations 12 and 14 (dimension "c") is approximately ⅓rd of width "b", also depending on the properties of the material; width "e" of tongue 16 is smaller than "c", the maximum distance "h" between side slots 22 and 24 is approximately equal to "d"; the minimum distance "f" between side slots is approximately equal to "c"; length "g" of transverse slot 20 is equal to the mean distance of "f" (minimum distance between the side slots) and "h" (maximum distance between the side slots) with the width of slot 20 not greater than half the thickness of the plastic sheet material.

Figure 2:
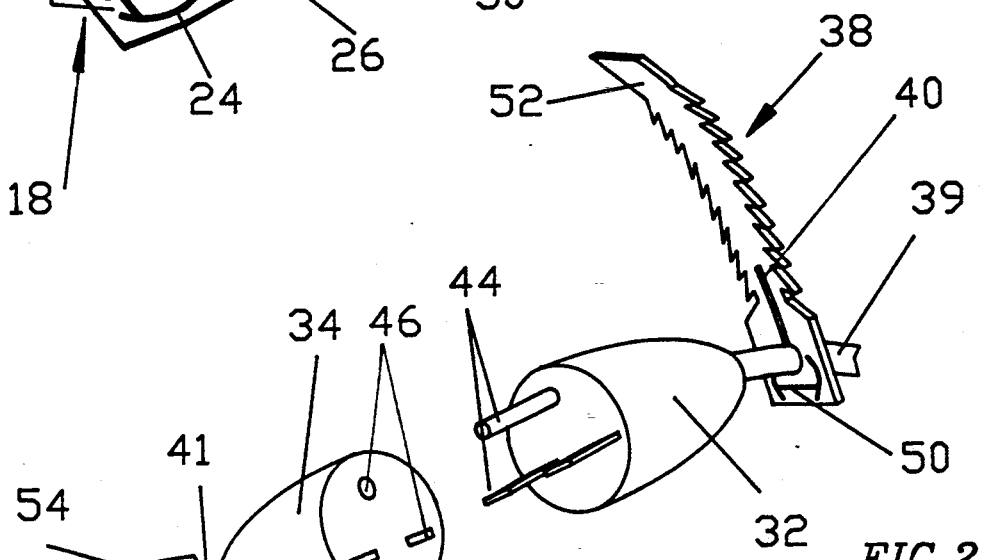
FIG. 2 is a perspective view of two locking strips placed on respective cords of a plug and receptacle prior to their electrical connection.
Figure 3:
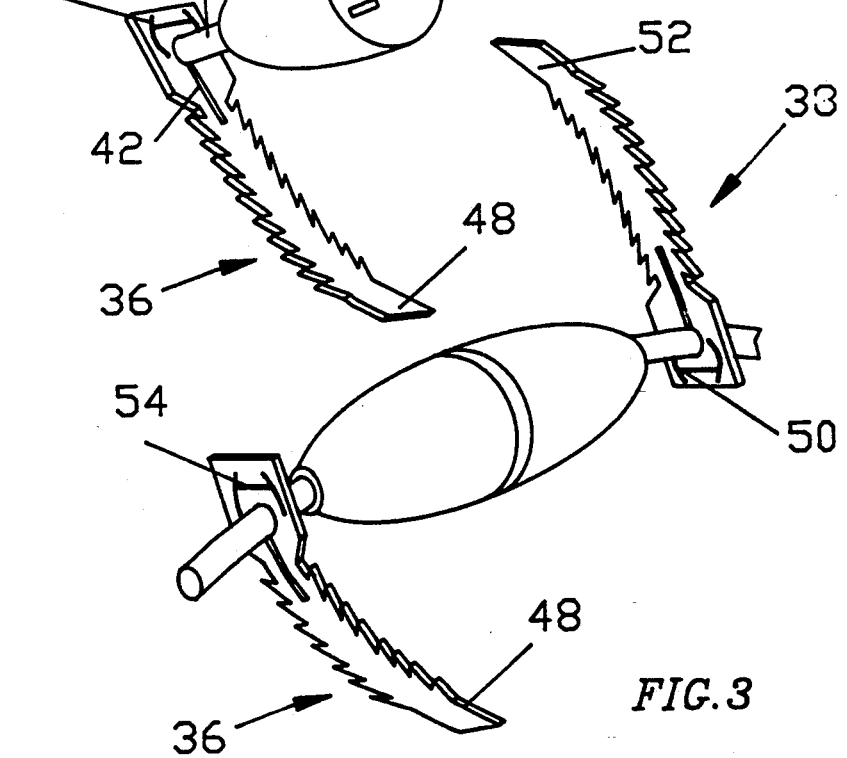
FIG. 3 is the same view as in FIG. 2 after the insertion of the plug into the receptacle, but prior to interconnection of the locking strips.
Figure 4:
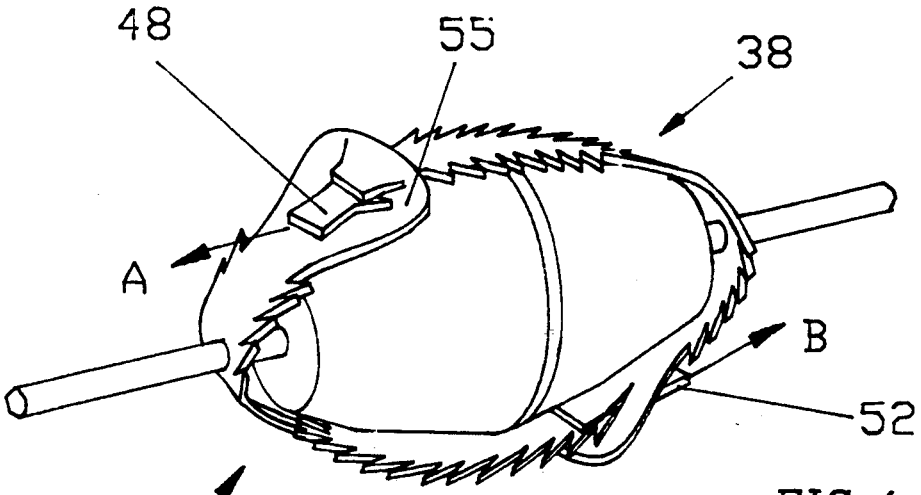
FIG. 4 is the same view as in FIG. 2, but after locking the plug and receptacle by means of the locking strips.

FIGS. 2, 3, AND 4—THE USE OF THE DEVICE FOR LOCKING ELECTRICAL CONNECTION BETWEEN PLUG AND RECEPTACLE

In order to provide a secure electric connection between a plug 32 (FIG. 2) and a receptacle 34, two locking strips 36 and 38 of the type shown in FIG. 1 and 1A are used.

Prior to connection of plug 32 to receptacle 34, locking strips 36 and 38 are placed on respective cords 39 and 41 by pulling plug 32 through slot 40 of strip 38 and receptacle 34 through slot 42 of strip 36. After the plug and the receptacle are pulled through these slots, cords 39 and 41 fit into respective openings 28 (FIG. 1) and the sides of each slot tightly closed due to resiliency of the material of the strip. This first step of the operation is shown in. FIG. 2.

Prongs 44 of plug 32 are then inserted into recesses 46 of receptacle 34, whereby the condition shown in FIG. 3 is obtained.

Tongue portion 48 of locking strip 36 is inserted into transverse slot 50 of locking strip 38, while tongue portion 52 of locking strip 38 is inserted into a transverse slot 54 of locking strip 36. Both tongues 48 and 52 are then pulled through respective slots sequentially or simultaneously.

When the tongues are pulled through the transverse slots in directions of arrows A and B of FIG. 4, the above-mentioned smaller flap-like piece gives way, allowing the serrated edges to wedge and to pass through transverse slots 50 and 54. Due to its flexibility, the smaller flap then returns to its initial position and thus locks the serrated edges against movement in the direction opposite to pulling of the tongue. As a result, the configuration shown in FIG. 4 is obtained. In this state, both strips 36 and 38 are tightened firmly around the plug and the receptacle, which are electrically interconnected and reliably held in the interconnected state by locking strips 36 and 38. Thus the mated plug and socket can be handled, pulled, and used without fear of unmating.

FIG. 5—DISCONNECTION OF LOCKING STRIPS

Figure 5:
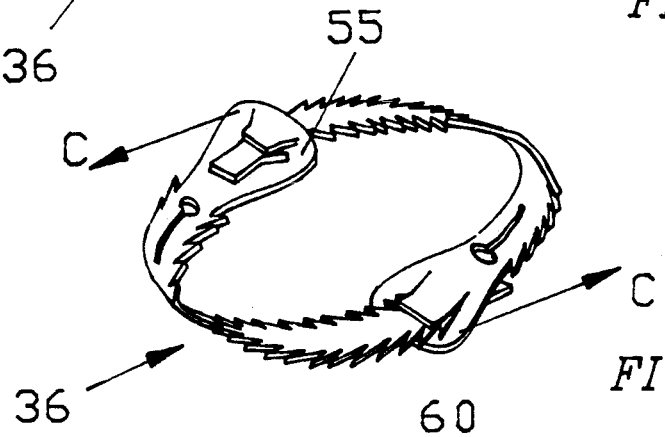
FIG. 5 is the same view as in FIG. 4 illustrating disconnection of locking strips from each other.

The device has multiple uses and can be easily removed when it is necessary to disconnect plug 32 from receptacle 34. For releasing the strips from each other, it is necessary to grasp head portion 55 of one strip, e.g., strip 36, with the fingers of one hand, and to grasp the remaining entire unit with fingers of the other hand (FIG. 5). Then head portion 55 is pulled in the direction of arrow C of FIG. 5, i.e., in the direction against facing teeth of the serrated portion of strip 36. When head portion 55 of strip 36 is pulled by one hand in the direction of arrow C against tongue 48 of strip 38 which is fixed by the other hand, the smaller and larger flaps are bent outward from the plane of the strip, thus widening transverse slot 50 to the extent that the head can easily pass though the serrated edges of strip 38 in the direction opposite to the inclination of the teeth. Head 52 is pulled until it is released from strip 38. The same operation is then repeated with regard to the head of strip 38 and the tongue of strip 36.

After disconnection of locking strips, the situation will be the same as in FIG. 3, so that plug 32 can be easily disconnected from receptacle 34. If necessary, strips 36 and 38 may remain on their respective cords 41 and 39 till the next electrical connection is required. Each strip will be reliably held on the cord due to friction forces developed by the flaps and cannot be lost, as a substantial force is required to pull the plug or receptacle through their strip's respective longitudinal slots.

FIG. 6—USE OF A SINGLE STRIP OF THE DEVICE FOR CORD KEEPING

Figure 6:
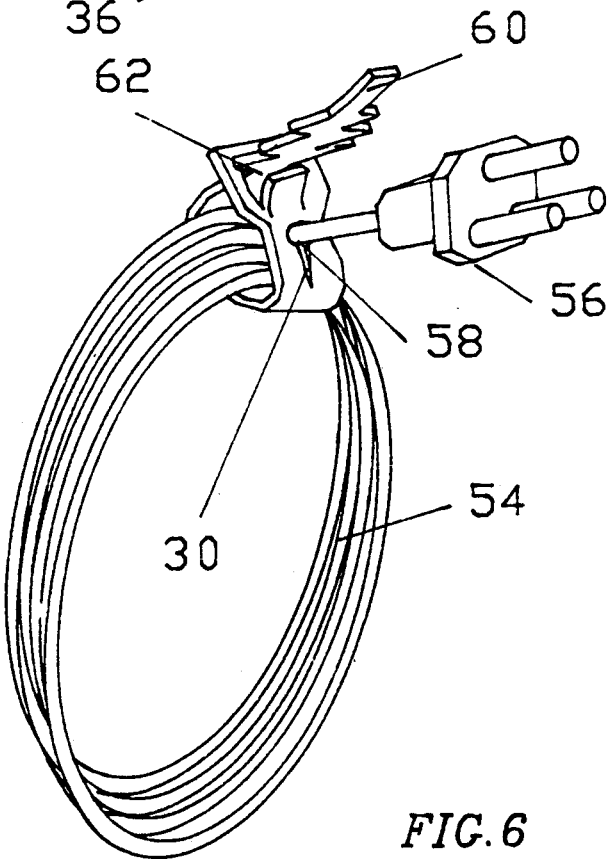
FIG. 6 is a perspective view illustrating the use of a single strip for holding a bundled extension cord and a plug.

FIG. 6 is a perspective view illustrating the use of a single strip for holding a coiled extension cord 54 and a plug 56.

For keeping an unused portion of cord 54 or for convenience of storage, the unused portion or, if necessary, the entire cord is coiled. Plug 56 (or a receptacle) is then pulled through longitudinal slot 58. A tongue 60 of the strip is pulled through transverse slot 62 in the same manner as it has been described above with regard to interconnection of two identical strips, with the exception that the tongue is pulled through the transverse slot of its own strip. As a result, the strip tightly embraces the cord bundle and holds it in the locked position until it is required to release the coiled bundle, e.g., for extension of the cord.

FIG. 7—LAYOUT OF THE PATTERN FOR MANUFACTURING THE STRIPS

Figure 7:
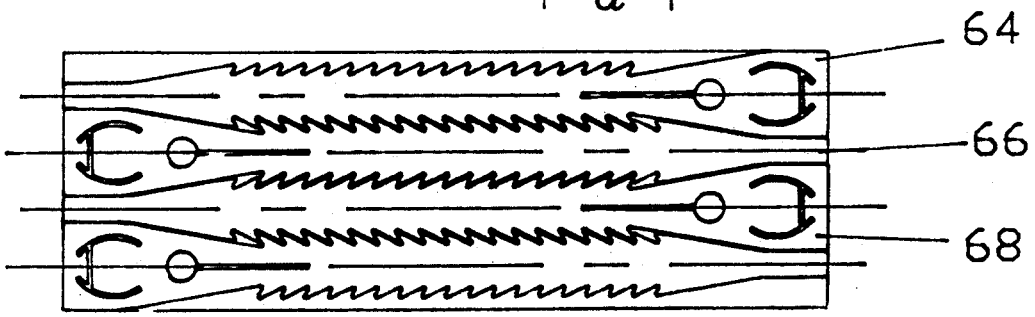
FIG. 7 is an example of a layout for manufacturing the locking strips by stamping from a plastic sheet.

FIG. 7 is an example of a layout for manufacturing the locking strips by stamping from a plastic sheet. It can be seen that the pattern shown in FIG. 7 offers an alternating arrangement of adjacent locking strips 64, 66, 68, . . . which are formed by cutting die (not shown), practically without waste. This technique is known and is given only for illustration purposes. If necessary, the strips can be molded individually in a multiple die (not shown).

SUMMARY, RAMIFICATIONS, SCOPE

Thus, it has been shown that the strip provides a combined holder and lock for electrical connections and cables which can be used either for keeping an electrical cord in a folded or looped state, or for holding a mated electrical plug and receptacle together. The strip is simple and inexpensive to manufacture, easy to use, reliable in operation, and convenient to store and transport. When used as a lock for a mated plug and socket, two identical strips are employed, thereby avoiding excess inventory.

Although the combined cable keeper and plug-receptacle holder has been shown and described in the form of one specific embodiment, this embodiment, its parts, materials, and configurations have been given only as examples, and many other modifications are possible. For example, a single locking strip may carry information and can be used as a label. It also can be used as a chuck key holder for an electric drill. The strip can be made not only of plastic, but of cardboard, thick paper, rubber, leather, etc. It can be used as a disposable item. The teeth may have a different profile and inclination. The hole may be oval or elliptical. Although only one strip was shown as a cable bundle keeper, it is understood that two such strips can be chained and used for wrapping around thick bundles. The strip's use is not limited to locking electrical connections; other applications based on the same principle can be utilized for keeping together any two interconnected parts, such as two parts joined through a snap connection which can get loose because of vibrations, etc.

Therefore, the scope of the invention should be determined, not by the example given, but by the appended claims and their legal equivalents.

What we claim is:

1. A releasable holder for holding an electrical connection between a plug and a receptacle on the ends of respective electrical cords, comprising:

a pair of identical strip-like members made of a flexible material, each of said members having a first end and a second end, each of said members having a longitudinal axis which divides it into two symmetrical parts, each of said members having cord-holding means for enabling said plug or said receptacle to pass through said member by applying a force to said plug or said receptacle when said plug or said receptacle is held against said member, said cord-holding means comprising a longitudinal slot cut through said strip-like member, said slot being arranged along said longitudinal axis, one of said members having locking means on said second end thereof for enabling said first end of the other of said members to pass freely through said one member in one direction and with a resistance in the direction opposite to said one direction, so that when both of said members, embrace an electrical connection between said plug and said receptacle, and said first end of at least one of said members is pulled, said connection will be tightened and locked, said locking means comprising a lock slot in said member, and serrations on opposite side edges of said member between said first end and said second end, said serrations and said lock slot being sized and shaped so that said serrations engage said lock slot when said first end of said second member is passed through said one member in said one direction.

2. The holder of claim 1 wherein said locking means comprises two side slots converging toward said second end and one transverse slot between said side slots.

3. The holder of claim 1 wherein said serrations are inclined toward said second end.

4. The holder of claim 3 wherein on its side opposite to said first end, said longitudinal slot terminates in a through-hole made in the material of said member, said second end being connected to said serrated portion by a portion tapering toward said serration, said transverse slot being spaced from the narrowest width between said converging side slots, so that it forms two bendable flaps located on both sides of said transverse slot, one of said flaps being a smaller flap and the other a larger flap.

5. The holder of claim 4 wherein said member has an overall length of 100 mm to 300 mm, an overall width of said second part within the range of 12 mm to 38 mm, a thickness of said flexible material within the range of 0.8 mm to 9.5 mm, a length of said longitudinal slot within the range of 12 mm to 90 mm, a distance between the tips of said serrations located on said opposite edges of said strip-like member equal to about ⅓rd of said overall width, a distance between cavities of said serrations on said opposite edges equal to approximately ⅓rd of said overall width, said first end being narrower than said distance between said serration cavities, the maximum distance between said side slots being approximately equal to said distance between said tips of said serrations, the minimum distance between said side slots being approximately equal to said distance between said serration troughs, and the width of said transverse slot being smaller than half the thickness of said flexible material.

6. The holder of claim 4 wherein said flexible material is polyethylene.

7. A releasable holder for holding an electrical cable having on one of its ends either a plug or a receptacle, said holder comprising:

a strip-like member made of a flexible material and having a first end and a second end, said member having a longitudinal axis which divides it into two symmetrical parts, cord-holding means for enabling said electrical plug or receptacle to pass through said member by applying a force to said plug or receptacle when said plug or said receptacle is held against said member, said cord-holding means comprising a longitudinal slot cut through said member, said slot being arranged along said longitudinal axis, and locking means on said second end of said member for enabling said first end of said second member to pass freely in one direction through said member and with a resistance in the direction opposite to said one direction, so that when said member embraces a bundle formed by coiling said electrical cable and said first end of said member is pulled in said one direction, said member will be tightened around said bundle and said bundle will be held together, said locking means comprising a lock slot in said member, and serrations on opposite side edges of said member between said fist end and said second end, said serrations and said lock slot being sized and shaped to that said serrations engage said lock slot when said first end of said second member is passed through said one member in said one direction.

8. The holder of claim 7 wherein said locking means comprises two side slot converging toward said second end and one transverse slot between said side slots.

9. The holder of claim 7 wherein on its side opposite to said first end, said member has a through hole made in the material of said, at its end opposite to said first end said longitudinal slot terminates in said hole, said second end of said member being connected to said serrated portion by a portion tapering toward said serrations, said transverse slot being spaced from the narrowest width between said converging side slots, so that it forms two bendable flaps located on both sides of said transverse slot, one of said flaps being relatively small, and the other being relatively large.

10. The holder of claim 9 wherein said member has an overall length of 100 mm to 300 mm, an overall width of said second part within the range of 12 mm to 38 mm, a thickness of said flexible material within the range of 0.8 mm to 9.5 mm, a length of said longitudinal slot within the range of 12 mm to 90 mm, a distance between the tips of said serrations located on said opposite edges of said strip-like member equal to about ⅔rd of said overall width, a distance between cavities of said serrations on said opposite edges equal to approximately ⅓rd of said overall width, said first and being narrower than said distance between said serration cavities, the maximum distance between said side slots being approximately equal to said distance between said tips of said serrations, the minimum distance between said side slots being approximately equal to said distance between said serration troughs, and the width of said transverse slot being smaller than half the thickness of said flexible material.

11. The holder of claim 10 wherein said flexible material is polyethylene.

12. A combined releasable holder and lock for holding an electrical connection between a plug and a receptacle on the ends of respective electrical cords, comprising:

a pair of identical strip-like members made of a flexible material, each of said members having a first end and a second end, each of said members having a longitudinal axis which divides it into two symmetrical parts, each of said members having cord-holding means for enabling said plug or said receptacle to pass through said member by applying a force to said plug or receptacle when said plug or said receptacle is held against said member, and said cord-holding means comprising a longitudinal slot cut through said strip-like member, said slot being arranged along said longitudinal axis, locking means on said second end of one of said members for enabling said first end of said second member to pass freely through said one member in one direction and with a resistance in the direction opposite to said one direction, so that when both of said members embrace an electrical connection between said plug and said receptacle, and said first end of at least one of said members is pulled, said connection will be tightened and locked, said locking means comprising a lock slot in said member, and serrations on opposite side edges of said member between said first end and said second end, said serrations and said lock slot being sized and shaped to that said serrations engage said lock slot when said first end of said second member is passed through said one member in said one direction.

13. The holder of claim 12 wherein said locking means comprises two side slots converging toward said second end and one transverse slot between said side slots.

14. The holder of claim 12 wherein said serrations are inclined toward said second end.

15. The holder of claim 14 wherein on its side opposite to said first end, said longitudinal slot terminates in a through hole made in the material of said strip-like member, said second end being connected to said serrated portion by a portion tapering toward said serrations, said transverse slot being spaced from the narrowest width between said converging side slots, so that it forms two bendable flaps located on both sides of said transverse slot, one of said flaps being relatively small and the other relatively larger.

16. The holder of claim 14 wherein said member has an overall length of 100 mm to 300 mm, an overall width of said second part within the range of 12 mm to 38 mm, a thickness of said flexible material within the range of 0.8 mm to 9.5 mm, a length of said longitudinal slot within the range of 12 mm to 90 mm, a distance between the tips of said serrations located on said opposite edges of said strip-like member equal to about ⅔rd or said overall width, a distance between cavities of said serrations on said opposite edges equal to approximately ⅓rd of said overall width, said first end being narrower than said distance between said serration cavities, the maximum distance between said side slots being approximately equal to said distance between said tips of said serrations, the minimum distance between said side slots being approximately equal to said distance between said serration troughs, and the width of said transverse slot being smaller than half the thickness of said flexible material.

17. The holder of claim 14 wherein said flexible material is plastic.

* * * * *